US008069841B2

(12) United States Patent
Giorgetti et al.

(10) Patent No.: US 8,069,841 B2
(45) Date of Patent: Dec. 6, 2011

(54) COUPLING ARRANGEMENT AND FUEL INJECTOR

(75) Inventors: Edoardo Giorgetti, Rosignano Marittimo (IT); Mauro Grandi, Leghorn (IT)

(73) Assignee: Continental Automotive GmbH, Hannover (DE)

( * ) Notice: Subject to any disclaimer, the term of this patent is extended or adjusted under 35 U.S.C. 154(b) by 283 days.

(21) Appl. No.: 12/421,802

(22) Filed: Apr. 10, 2009

(65) Prior Publication Data

US 2009/0308954 A1 Dec. 17, 2009

(30) Foreign Application Priority Data

Apr. 23, 2008 (EP) ..... 08007858

(51) Int. Cl.
*F02M 61/18* (2006.01)

(52) U.S. Cl. ..... 123/470; 123/456

(58) Field of Classification Search ..... 123/470, 123/469, 468, 456, 447; 239/600; 285/319, 285/305, 348
See application file for complete search history.

(56) References Cited

U.S. PATENT DOCUMENTS

| | | | | |
|---|---|---|---|---|
| 6,102,007 | A * | 8/2000 | Furst | 123/469 |
| 6,419,282 | B1 | 7/2002 | Hornby | |
| 6,640,784 | B1 * | 11/2003 | Sims, Jr. | 123/470 |
| 6,701,899 | B2 * | 3/2004 | Liskow | 123/470 |
| 2005/0115546 | A1 * | 6/2005 | Liskow | 123/469 |
| 2009/0013968 | A1 * | 1/2009 | Keegan et al. | 123/470 |

FOREIGN PATENT DOCUMENTS

| | | | |
|---|---|---|---|
| EP | 1849995 | A1 | 10/2007 |
| WO | WO 2006063689 | A | 6/2006 |

* cited by examiner

*Primary Examiner* — Mahmoud Gimie
(74) *Attorney, Agent, or Firm* — King & Spalding L.L.P.

(57) ABSTRACT

A coupling arrangement for coupling a fuel injector to a fuel rail of a combustion engine, has a fuel injector cup having a central longitudinal axis and is coupled to the fuel rail at a first axial end area of the fuel injector cup, a housing of the fuel injector being arranged at the central longitudinal axis facing a second axial end area of the fuel injector cup, an O-ring seal being arranged between the housing and the fuel injector cup at an axially overlapping area of the fuel injector cup and the housing, a back-up ring being arranged at least partly circumferentially the housing such as to prevent the O-ring seal to be released from the housing, and a separating element being arranged at least partly circumferentially the housing between the O-ring seal and the back-up ring to prevent a contact of the O-ring seal with the back-up ring.

20 Claims, 3 Drawing Sheets

COUPLING ARRANGEMENT AND FUEL INJECTOR

CROSS-REFERENCE TO RELATED APPLICATIONS

This application claims priority to European Patent Application No. EP08007858, filed Apr. 23, 2008. The complete disclosure of the above-identified application is hereby fully incorporated herein by reference.

TECHNICAL FIELD

The invention relates to a coupling arrangement for coupling a fuel injector to a fuel rail of a combustion engine and the fuel injector.

BACKGROUND

Coupling arrangements for hydraulically and mechanically coupling a fuel injector to a fuel rail are in widespread use, in particular for internal combustion engines. Fuel can be supplied to an internal combustion engine by the fuel rail assembly through the fuel injector. The fuel injectors can be coupled to the fuel injector cups in different manners.

In order to keep pressure fluctuations during the operation of the internal combustion engine at a very low level, internal combustion engines are supplied with a fuel accumulator to which the fuel injectors are connected and which has a relatively large volume. Such a fuel accumulator is often referred to as a common rail.

Known fuel rails comprise a hollow body with recesses in form of fuel injector cups, wherein the fuel injectors are arranged. The connection of the fuel injectors to the fuel injector cups that supply the fuel from a fuel tank via a low or high-pressure fuel pump needs to be very precise to get a correct injection angle and a sealing of the fuel.

SUMMARY

According to various embodiments, a coupling arrangement for coupling a fuel injector to a fuel rail can be created which is simply to be manufactured and which facilitates a reliable operation.

According to an embodiment, a coupling arrangement for coupling a fuel injector to a fuel rail of a combustion engine, may comprise—a fuel injector cup having a central longitudinal axis and being designed to be coupled to the fuel rail at a first axial end area of the fuel injector cup, —a housing of the fuel injector being arranged at the central longitudinal axis facing a second axial end area of the fuel injector cup, —an O-ring seal being arranged between the housing and the fuel injector cup at an axially overlapping area of the fuel injector cup and the housing, —a back-up ring being arranged at least partly circumferentially the housing such as to prevent the O-ring seal to be released from the housing, and —a separating element being arranged at least partly circumferentially the housing between the O-ring seal and the back-up ring such as to prevent a contact of the O-ring seal with the back-up ring.

According to a further embodiment, the back-up ring may comprise a metal. According to a further embodiment, the back-up ring may comprise stainless steel. According to a further embodiment, the separating element may comprise a plastic. According to a further embodiment, the separating element may comprise polytetrafluoroethylene. According to a further embodiment, the back-up ring may comprises a larger outer diameter at a first axial end area of the back-up ring facing the separating element than at a second axial end area of the back-up ring facing away from the separating element. According to a further embodiment, the separating element may comprise a larger outer diameter than the back-up ring. According to a further embodiment, the separating element may comprise a flange, which is arranged at least partly at the fuel injector cup axially overlapping with at least a part of the back-up ring, wherein the flange is arranged such as to prevent a contact of the fuel injector cup with the back-up ring. According to a further embodiment, the housing may comprise a first part of the housing facing the fuel injector cup and a second part of the housing facing away from the fuel injector cup, wherein the first part of the housing comprises a smaller outer diameter than the second part of the housing. According to a further embodiment, the O-ring seal, the separating element and the back-up ring may be arranged at least partly circumferentially the first part of the housing. According to a further embodiment, the back-up ring may be in contact with at least a part of the second part of the housing.

According to another embodiment, a fuel injector with a valve assembly within a cavity and a coupling arrangement as described above, may comprise a solid state actuator unit within the cavity, wherein the solid state actuator unit is designed for acting on the valve assembly.

BRIEF DESCRIPTION OF THE DRAWINGS

Exemplary embodiments are explained in the following with the aid of schematic drawings. These are as follows.

DETAILED DESCRIPTION

Figure 1:
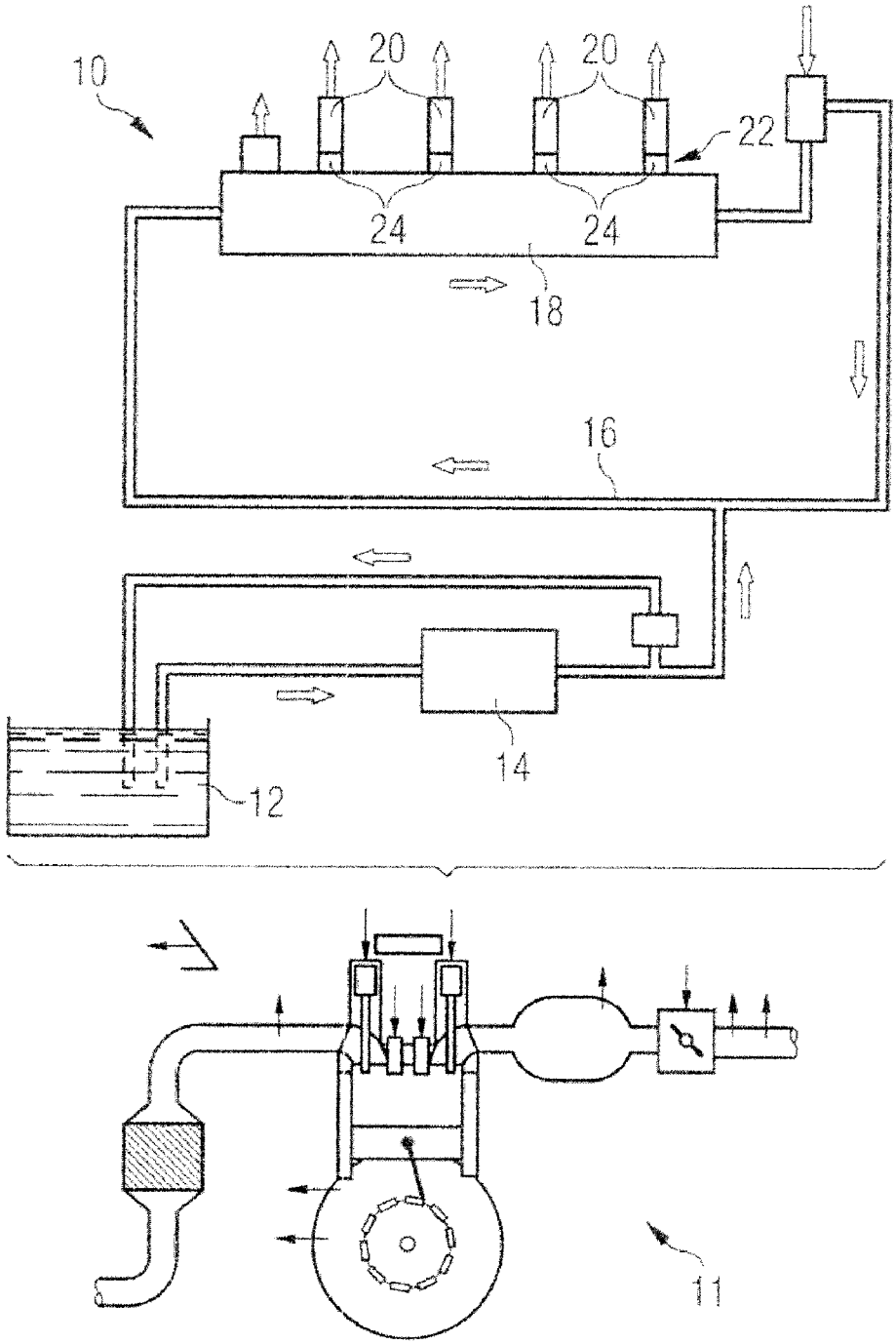
FIG. 1 an internal combustion engine in a schematic view.

According to a first aspect, a coupling arrangement for coupling a fuel injector to a fuel rail of a combustion engine, the coupling arrangement comprising a fuel injector cup having a central longitudinal axis and being designed to be coupled to the fuel rail at a first axial end area of the fuel injector cup, a housing of the fuel injector being arranged at the central longitudinal axis facing a second axial end area of the fuel injector cup, an O-ring seal being arranged between the housing and the fuel injector cup at an axially overlapping area of the fuel injector cup and the housing, a back-up ring being arranged at least partly circumferentially the housing such as to prevent the O-ring seal to be released from the housing, and a separating element being arranged at least partly circumferentially the housing between the O-ring seal and the back-up ring such as to prevent a contact of the O-ring seal with the back-up ring.

This has the advantage that a fast and secure coupling between the fuel injector and the fuel injector cup may be achieved. For instance, the O-ring seal, the back-up ring and the separating element may be designed and arranged such as to enable a secure coupling of the housing of the fuel injector to the fuel injector cup at the second axial end area of the fuel injector cup. For example, the separating element may prevent the back-up ring to be released from the housing. The fuel injector cup may be designed for hydraulically coupling it to the fuel rail. The coupling arrangement may resist the high fuel pressures in the fuel injector and the fuel injector cup in a simple way. Furthermore, such a coupling arrangement may be easy to be manufactured. In addition, a good accessibility from the top of the coupling arrangement may be enabled. Moreover, a rearrangement of the coupling arrangement, for instance the O-ring seal, may be enabled and therewith a rearrangement of the fuel injector. Therefore, a simple construction of the coupling arrangement may be enabled, which enables to carry out a fast and secure but reversible coupling of the housing of the fuel injector to the fuel injector cup. For example, the back-up ring may comprise plastic. Thus, the coupling arrangement comprising the separating element may prevent a plastic deformation of the back-up ring, which may be caused by the O-ring seal. For example to support the arrangement of the O-ring seal at the housing, the separating element is arranged in addition to the back-up ring. To avoid or limit a damage of the O-ring seal, for example especially during pressure relief phase, the separating element is arranged between the O-ring seal and the back-up ring as a protection for the O-ring seal. Especially to prevent or limit a damage of the O-ring seal caused by the back-up ring, for example a pinch of the O-ring seal caused by the back-up ring, the separating element is arranged between the O-ring seal and the back-up ring. In an embodiment the back-up ring comprises a metal.

The back-up ring may comprise metal to enhance the strength of the support of the O-ring seal and therewith the sealing within the coupling arrangement. Thus, an especially secure coupling between the fuel injector cup and the fuel injector may be enabled. To provide an especially firm support of the O-ring seal and for instance to prevent the O-ring seal to be released from the housing in an especially reliable way, the back-up ring may comprise a high proportion of metal, for example the back-up ring may consist to 100% of metal. In particular, an especially firm support of the O-ring seal may be provided by the back-up ring comprising a high proportion of metal for example compared to a back-up ring comprising plastic. Thus, a plastic deformation of the back-up ring may be prevented. Moreover, the coupling arrangement may resist high fuel pressures in the fuel injector and the fuel injector cup in a simple and reliable way. Thus, an especially reliable operation of the coupling arrangement may be enabled. Moreover, the coupling via the back-up ring comprising a high proportion of metal may be simply to be manufactured and facilitates a reliable and precise connection between the fuel injector cup and the housing of the fuel injector. In a further embodiment the back-up ring comprises stainless steel.

The back-up ring may comprise stainless steel to enhance the strength of the support of the O-ring seal and therewith the sealing within the coupling arrangement. Thus, an especially secure coupling between the fuel injector cup and the fuel injector may be enabled. To provide an especially firm support of the O-ring seal and for instance prevent the O-ring seal to be released from the housing in an especially reliable way, the back-up ring may comprise a high proportion of stainless steel, for example the back-up ring may consist to 100% of stainless steel. In addition, corrosion problems of the back-up ring may be prevented by using stainless steel. In a further embodiment the separating element comprises a plastic.

To protect the O-ring seal to be damaged for example by a contact with a metal such as a metallic back-up ring, the separating element may comprise plastic. To avoid a wearing or damage of the O-ring seal, for example a pinch of the O-ring seal caused by the back-up ring and/or a sharp edge of a metallic back-up ring, the separating element is arranged between the O-ring seal and the back-up ring comprising plastic as a protection for the O-ring seal. Thus, an especially secure coupling between the fuel injector cup and the fuel injector may be enabled.

In a further embodiment the separating element comprises polytetrafluoroethylene.

For example, the separating element may comprise Teflon, which for instance comprises a low friction coefficient. Thus, a wearing of the O-ring seal being arranged at the separating element caused by the contact between the separating element and the O-ring seal may be limited or avoided in an especially reliable way. Moreover, a wearing of the back-up ring being arranged at the separating element caused by the contact between the separating element and the back-up ring may be limited. Thus, an especially secure coupling between the fuel injector cup and the fuel injector may be enabled.

In a further embodiment the back-up ring comprises a larger outer diameter at a first axial end area of the back-up ring facing the separating element than at a second axial end area of the back-up ring facing away from the separating element. In particular, the back-up ring may comprise a larger outer diameter at a first axial end area of the back-up ring facing the O-ring seal than at a second axial end area of the back-up ring facing away from the O-ring seal. This has the advantage that for instance the back-up ring may adapt occurring forces at the back-up ring caused by a compression of the O-ring seal in a better and faster way than in the case of a back-up ring with the same outer diameter at both axial end areas. For example, an angled cut of the back-up ring may help the progressive adaption of the support while pressure is increasing.

In a further embodiment the separating element comprises a larger outer diameter than the back-up ring.

For example, the larger outer diameter of the separating element compared to the outer diameter of the back-up ring may prevent a wearing and damage caused by a contact between the back-up ring, for example a metallic back-up ring, and the fuel injector cup. Especially in the case of a back-up ring comprising metal, the larger outer diameter of the separating element compared to the outer diameter of the back-up ring may prevent a wearing caused by a contact of the fuel injector cup with the metallic part of the back-up ring.

Since the back-up ring may comprise metal or consist of metal and the separating element may be made of another material than the back-up ring such as plastic, a wearing between the separating element and the fuel injector cup may be limited or prevented in a simple way. Thus, reliable operation of the coupling arrangement may be enabled.

In a further embodiment the separating element comprises a flange, which is arranged at least partly at the fuel injector cup axially overlapping with at least a part of the back-up ring, wherein the flange is arranged such as to prevent a contact of the fuel injector cup with the back-up ring.

For example, the flange may be arranged at least partly parallel to the central longitudinal axis of the fuel injector cup at the fuel injector cup. For example, the flange may prevent in an especially reliable way a wearing caused by a contact between the back-up ring, for example a metallic back-up ring, and the fuel injector cup. Since the back-up ring may comprise metal or consist of metal and the separating element may be made of another material than the back-up ring such as plastic, a wearing caused by the contact between the separating element and the fuel injector cup may be limited or prevented in a simple way. Thus, reliable operation of the coupling arrangement may be enabled.

In a further embodiment the housing comprises a first part of the housing facing the fuel injector cup and a second part of the housing facing away from the fuel injector cup, wherein the first part of the housing comprises a smaller outer diameter than the second part of the housing.

By this, additional contact area may be provided for instance for a coupling device, which may couple the housing of the fuel injector to the fuel injector cup. This has the advantage that a simple coupling of the housing of the fuel injector to the fuel injector cup may be enabled. For example, the outer diameter of the first part of the housing facing the fuel injector cup may be adjusted to the inner diameter of the fuel injector cup in such a way to enable a secure coupling of the housing of the fuel injector to the fuel injector cup in a simple way. Moreover, a simple manufacturing of the housing may be possible.

In a further embodiment the O-ring seal, the separating element and the back-up ring are arranged at least partly circumferentially the first part of the housing. For example, the second part of the housing comprising a larger outer diameter than the first part of the housing may prevent the O-ring seal, the separating element and the back-up ring to be released from the first part of the housing in a simple way. For example, a movement of the O-ring seal, the separating element and the back-up ring relative to the housing of the fuel injector at least in one direction of the central longitudinal axis may be prevented. Thus, a secure coupling of the housing of the fuel injector to the fuel injector cup may be enabled in a simple way.

In a further embodiment the back-up ring is in contact with at least a part of the second part of the housing. For example, the back-up ring may be arranged at least partly circumferentially the first part of the housing being in contact with at least a part of the second part of the housing, wherein the first part of the housing comprises a smaller outer diameter than the second part of the housing. Thus, the second part of the housing may prevent the back-up ring to be released from the first part of the housing. Moreover, the back-up ring may support the arrangement of the O-ring seal and the separating element in an especially reliable way and prevent them to be released from the housing. Thus, a secure coupling of the housing of the fuel injector to the fuel injector cup may be enabled in a simple way.

According to a second aspect, a fuel injector with a valve assembly within a cavity and a coupling arrangement of the first aspect, comprises a solid state actuator unit within the cavity, wherein the solid state actuator unit is designed for acting on the valve assembly.

Elements of the same design and function that occur in different illustrations are identified by the same reference character.

A fuel feed device 10 is assigned to an internal combustion engine 11 (FIG. 1) which can be a diesel engine or a gasoline engine. It includes a fuel tank 12 that is connected via a first fuel line to a fuel pump 14. The output of the fuel pump 14 is connected to a fuel inlet 16 of a fuel rail 18. In the fuel rail 18, the fuel is stored for example under a pressure of about 200 bar in the case of a gasoline engine or of about 2,000 bar in the case of a diesel engine. Fuel injectors 20 are coupled to the fuel rail 18 and the fuel is fed to the fuel injectors 20 via the fuel rail 18. Coupling arrangements 22 for coupling the fuel injectors 20 to the fuel rail 18 of the combustion engine 11 comprise a fuel injector cup 24.

Figure 2:
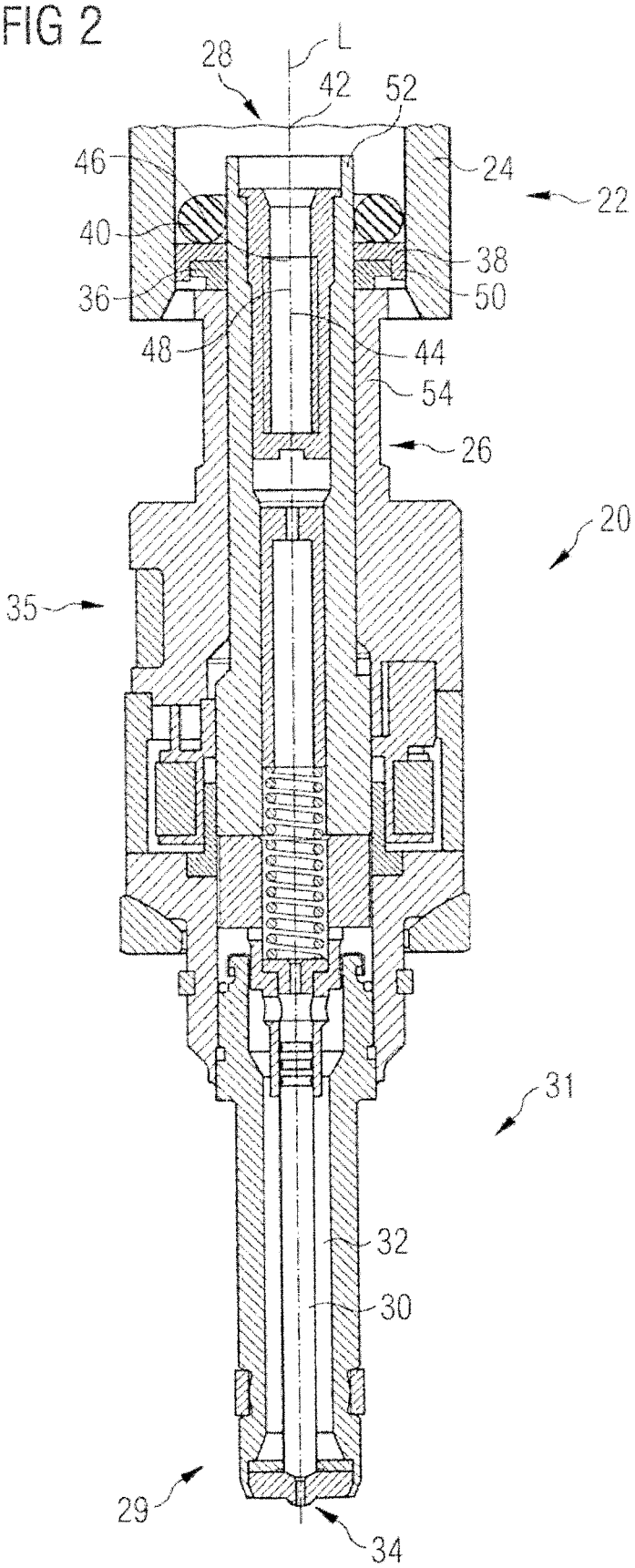
FIG. 2 a longitudinal section through a fuel injector with a first embodiment of a coupling arrangement, and FIG. 3 a longitudinal section through a second embodiment of the coupling arrangement.

FIG. 2 shows an exemplary embodiment of the fuel injector 20. The fuel injector 20 has a housing 26 of the fuel injector 20 and is suitable for injecting fuel into a combustion chamber of the internal combustion engine 11. The fuel injector 20 has a fuel inlet portion 28 and a fuel outlet portion 29.

Furthermore, the fuel injector 20 comprises a valve needle 30 being part of a valve assembly 31, wherein the valve needle 30 is taken in a cavity 32 of the housing 26 of the fuel injector 20. On a free end of the fuel injector 20 an injection nozzle 34 of the valve assembly 31 is formed, which is closed or opened by an axial movement of the valve needle 30. In a closing position a fuel flow through the injection nozzle 34 is prevented. In an opening position fuel can flow through the injection nozzle 34 into the combustion chamber of the internal combustion engine 11.

Moreover, the fuel injector 20 may comprise a solid state actuator unit 35 being designed for acting on the valve assembly 31. The solid state actuator unit 35 may comprise a solid state actuator, which changes its length in axial direction depending on a control signal applied to it such as electric energy supplied to it. The solid state actuator unit 35 is typically a piezo actuator unit. It may however also be any other solid state actuator unit known to the person skilled in the art such as a magnetostrictive actuator unit. On a drive side of the solid state actuator unit 35 the valve needle 30 is arranged.

Furthermore, FIG. 2 shows a first embodiment of the coupling arrangement 22 for coupling the fuel injector 20 to the fuel rail 18. The coupling arrangement 22 comprises the fuel injector cup 24, the housing 26 of the fuel injector 20, a back-up ring 36, a separating element 38 and an O-ring seal 40. The fuel injector cup 24 has a central longitudinal axis L and is designed to be coupled to the fuel rail 18 at a first axial end area 42 of the fuel injector cup 24 and to the housing 26 of the fuel injector 20 at a second axial end area 44 of the fuel injector cup 24.

For example in a further embodiment, the fuel injector cup 24 may comprise a larger outer diameter at the second axial end area 44 of the fuel injector cup 24 than at the first axial end area 42. For instance in a further embodiment, the fuel injector cup 24 may comprise a larger inner diameter at the second axial end area 44 of the fuel injector cup 24 than at the first axial end area 42.

The housing 26 of the fuel injector 20 is arranged at the central longitudinal axis L facing the second axial end area 44 of the fuel injector cup 24. The O-ring seal 40 is arranged between the housing 26 and the fuel injector cup 24 at an axially overlapping area of the fuel injector cup 24 and the housing 26 in order to have a proper sealing between the housing 26 of the fuel injector 20 and the fuel injector cup 24. The back-up ring 36 is arranged at least partly circumferentially the housing 26 such as to prevent the O-ring seal 40 to be released from the housing 26. The separating element 38 is arranged at least partly circumferentially the housing 26 between the O-ring seal 40 and the back-up ring 36 such as to prevent a contact of the O-ring seal 40 with the back-up ring 36. Moreover, the separating element 38 may support the placement of the O-ring seal 40 at the housing 26.

For instance, the O-ring seal 40, the back-up ring 36 and the separating element 38 may be designed and arranged such as to enable a coupling of the housing 26 of the fuel injector 20 to the fuel injector cup 24 at the second axial end area 44 of the fuel injector cup 24. For example, the separating element 38 may prevent the back-up ring 36 to be released from the housing 26. In the case of a back-up ring 36 comprising plastic, the separating element 38 may prevent a plastic deformation of the back-up ring 36, which may be caused by the O-ring seal 40.

The back-up ring 36 may comprise metal to enhance the strength of the support of the O-ring seal 40 and therewith the sealing within the coupling arrangement 22. For example, the back-up ring 36 may comprise stainless steel. To provide an especially firm support of the O-ring seal 40 and for instance prevent the O-ring seal 40 to be released from the housing 26, the back-up ring 36 may comprise a high proportion of metal, for example the back-up ring may consist to 100% of metal. Thus, a plastic deformation of the back-up ring 36 may be prevented.

To protect the O-ring seal 40 to be damaged for example by a contact with a metal such as a metallic back-up ring 36, the separating element 38 may comprise plastic. For instance, the separating element 38 may comprise polytetrafluoroethylene. To avoid a damage of the O-ring seal 40, for example a damage of the O-ring seal 40 caused by a sharp edge of a metallic back-up ring 36, the separating element 38 is arranged between the O-ring seal 40 and the back-up ring 36 comprising plastic as a protection for the O-ring seal 40. For example, the separating element 38 may comprise Teflon, which for instance comprises a low friction coefficient. Thus, a wearing caused by the contact between the O-ring seal 40 and the separating element 38 may be limited.

The back-up ring 36 may comprise a larger outer diameter at a first axial end area 46 of the back-up ring 36 facing the separating element 38 than at a second axial end area 48 of the back-up ring 36 facing away from the separating element 38. For example, an angled cut of the back-up ring 36 may help the progressive adaption of the support of the O-ring seal 40 while pressure is increasing.

For example, the separating element 38 comprises a larger outer diameter than the back-up ring 36 to prevent a wearing and damage caused by a contact between the back-up ring 36, for example a metallic back-up ring 36, and the fuel injector cup 24. Furthermore, the separating element 38 comprises a flange 50, which is arranged at least partly at the fuel injector cup 24 axially overlapping with at least a part of the back-up ring 36. The flange 50 of the separating element 38 is arranged such as to prevent a contact of the fuel injector cup 24 with the back-up ring 36. For example, the flange 50 may be arranged at least partly parallel to the central longitudinal axis L of the fuel injector cup 24 at the fuel injector cup 24. A wearing caused by the contact between the back-up ring 36, for example a metallic back-up ring 36, and the fuel injector cup 24 may be prevented by the flange 50.

Preferably, the housing 26 of the fuel injector 20 comprises a first part 52 of the housing 26 facing the fuel injector cup 24 and a second part 54 of the housing 26 facing away from the fuel injector cup, wherein the first part 52 of the housing 26 comprises a smaller outer diameter than the second part 54 of the housing 26. In this exemplary embodiment, the O-ring seal 40, the separating element 38 and the back-up ring 36 are arranged at least partly circumferentially the first part 52 of the housing 26. For instance, the back-up ring 36 is in contact with at least a part of the second part 54 of the housing 26 such as to prevent the back-up ring 36, the O-ring seal 40 and the separating element 38 to be released from the first part 52 of the housing 26. For example, a movement of the O-ring seal 40, the separating element 38 and the back-up ring 36 relative to the housing 26 of the fuel injector 20 at least in one direction of the central longitudinal axis L may be prevented.

Moreover, a sealing between the housing 26 of the fuel injector 20 and a combustion chamber of the internal combustion engine 11 may be carried out by a plastic element, in particular by a PTFE element.

Figure 3:
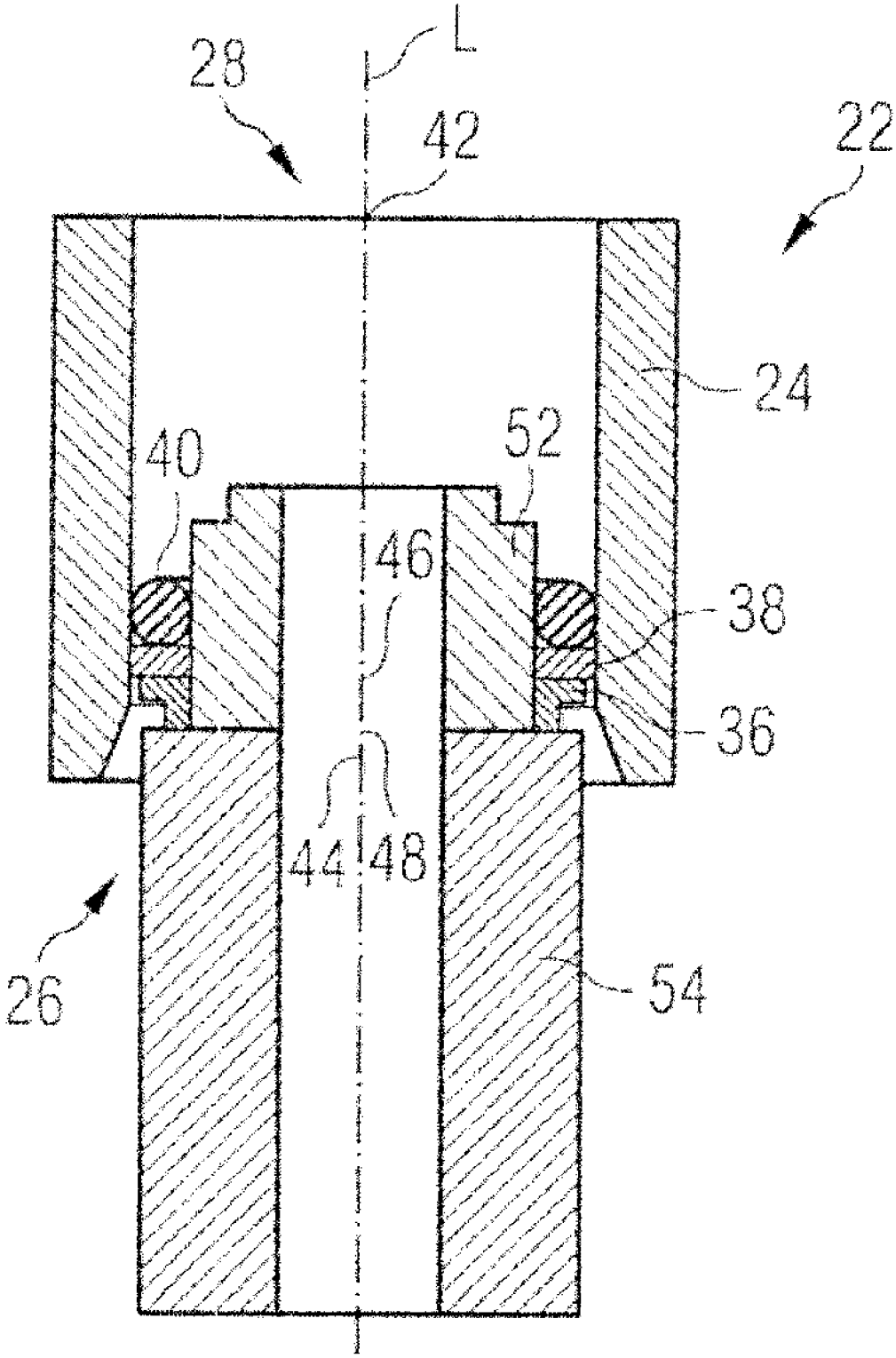

FIG. 3 shows a longitudinal section through a second embodiment of the coupling arrangement 22 for coupling the fuel injector 20 to the fuel rail 18. The fuel injector cup 24 is in engagement with the fuel inlet portion 28 of the fuel injector 20.

The coupling arrangement 22 comprises the fuel injector cup 24, the housing 26 of the fuel injector 20, the back-up ring 36, the separating element 38 and the O-ring seal 40. The fuel injector cup 24 has the central longitudinal axis L and is designed to be coupled to the fuel rail 18 at the first axial end area 42 of the fuel injector cup 24 and to the housing 26 of the fuel injector 20 at the second axial end area 44 of the fuel injector cup 24.

The housing 26 of the fuel injector 20 is arranged at the central longitudinal axis L facing the second axial end area 44 of the fuel injector cup 24. Preferably, the housing 26 of the fuel injector 20 comprises the first part 52 of the housing 26 facing the fuel injector cup 24 and the second part 54 of the housing 26 facing away from the fuel injector cup 24, wherein the first part 52 of the housing 26 comprises a smaller outer diameter than the second part 54 of the housing 26.

The O-ring seal 40 is arranged between the housing 26 and the fuel injector cup 24 at an axially overlapping area of the fuel injector cup 24 and the housing 26 in order to have a proper sealing between the housing 26 of the fuel injector 20 and the fuel injector cup 24. In this exemplary embodiment, the O-ring seal 40, the separating element 38 and the back-up ring 36 are arranged at least partly circumferentially the first part 52 of the housing 26. The separating element 38 is arranged between the O-ring seal 40 and the back-up ring 36 such as to prevent a contact of the O-ring seal 40 with the back-up ring 36. For example, the separating element 38 may support the placement of the O-ring seal 40 at the housing 26. For instance, the back-up ring 36 is in contact with at least a part of the second part 54 of the housing 26 such as to prevent the back-up ring 36 and therewith the O-ring seal 40 and the separating element 38 to be released from the first part 52 of the housing 26. For example, a movement of the O-ring seal 40, the separating element 38 and the back-up ring 36 relative to the housing 26 of the fuel injector 20 at least in one direction of the central longitudinal axis L may be prevented.

For instance, the O-ring seal 40, the back-up ring 36 and the separating element 38 may be designed and arranged such as to enable a coupling of the housing 26 of the fuel injector 20 to the fuel injector cup 24 at the second axial end area 44 of the fuel injector cup 24.

To protect the O-ring seal 40 to be damaged for example by a contact with a metallic back-up ring 36, the separating element 38 may comprise plastic. For instance, the separating element 38 may comprise polytetrafluoroethylene. For example, the separating element 38 may comprise Teflon. Thus, a wearing caused by the contact between the O-ring seal 40 and the separating element 38 may be limited.

The back-up ring 36 may comprise a larger outer diameter at a first axial end area 46 of the back-up ring 36 facing the separating element 38 than at a second axial end area 48 of the back-up ring 36 facing away from the separating element 38. For example, an angled cut of the back-up ring 36 may help the progressive adaption of the support of the O-ring seal 40 while pressure is increasing.

For example, the separating element 38 comprises a larger outer diameter than the back-up ring 36. Thus, a wearing and damage caused by a contact between the back-up ring 36, for example a metallic back-up ring 36, and the fuel injector cup 24 may be prevented.

In the following, the assembly and disassembly of the housing 26 of the fuel injector 20 with the fuel injector cup 24 according to the exemplary embodiment of FIG. 3 will be described:

For assembling, the back-up ring 36 is shifted over the housing 26 of the fuel injector 20 and arranged at least partly circumferentially the first part 52 of the housing 26 being in contact with the second part 54 of the housing 26. The separating element 38 is arranged at least partly circumferentially the first part 52 of the housing 26 being in contact with the back-up ring 36. The O-ring seal 40 is arranged at least partly circumferentially the first part 52 of the housing 26 being in contact with the separating element 38. Furthermore, the housing 26 of the fuel injector 20 is engaged into the fuel injector cup 24 in such a way that the O-ring seal 40 is arranged between the housing 26 and the fuel injector cup 24 at an axially overlapping area of the fuel injector cup 24 and the housing 26 in order to have a proper sealing between the housing 26 of the fuel injector 20 and the fuel injector cup 24.

To disassemble the housing 26 of the fuel injector 20 from the fuel injector cup 24, the O-ring seal 40 may be removed and the housing 26 of the fuel injector 20 can be shifted away from the fuel injector cup 24 in axial direction and the fuel injector cup 24 and the fuel injector 20 can be separated from each other.

The invention is not restricted to the explained embodiments. For example, the fuel injector cup 24, the back-up ring 36 and the separating element 38 may comprise alternative shapes. Further, the housing 26 of the fuel injector 20 may comprise alternative shapes.

What is claimed is:

1. A coupling arrangement for coupling a fuel injector to a fuel rail of a combustion engine, the coupling arrangement comprising a fuel injector cup having a central longitudinal axis and being designed to be coupled to the fuel rail at a first axial end area of the fuel injector cup, a housing of the fuel injector being arranged at the central longitudinal axis facing a second axial end area of the fuel injector cup, an O-ring seal being arranged between the housing and the fuel injector cup at an axially overlapping area of the fuel injector cup and the housing, wherein when sealing, the O-ring seal being in direct contact with said housing and said fuel injector cup, a back-up ring being arranged at least partly circumferentially the housing such as to prevent the O-ring seal to be released from the housing, and a separating element being arranged at least partly circumferentially the housing between the O-ring seal and the back-up ring such as to prevent a contact of the O-ring seal with the back-up ring.

2. The coupling arrangement according to claim 1, wherein the back-up ring comprises a metal.

3. The coupling arrangement according to claim 2, wherein the back-up ring comprises stainless steel.

4. The coupling arrangement according to claim 1, wherein the separating element comprises a plastic.

5. The coupling arrangement according to claim 1, wherein the separating element comprises polytetrafluoroethylene.

6. The coupling arrangement according to claim 1, wherein the back-up ring comprises a larger outer diameter at a first axial end area of the back-up ring facing the separating element than at a second axial end area of the back-up ring facing away from the separating element.

7. The coupling arrangement according to claim 1, wherein the separating element comprises a larger outer diameter than the back-up ring.

8. The coupling arrangement according to claim 1, wherein the separating element comprises a flange, which is arranged at least partly at the fuel injector cup axially overlapping with at least a part of the back-up ring, wherein the flange is arranged such as to prevent a contact of the fuel injector cup with the back-up ring.

9. The coupling arrangement according to claim 1, wherein the housing comprises a first part of the housing facing the fuel injector cup and a second part of the housing facing away from the fuel injector cup, wherein the first part of the housing comprises a smaller outer diameter than the second part of the housing.

10. The coupling arrangement according to claim 1, wherein the O-ring seal, the separating element and the back-up ring are arranged at least partly circumferentially the first part of the housing.

11. The coupling arrangement according to claim 9, wherein the back-up ring is in contact with at least a part of the second part of the housing.

12. A fuel injector with a valve assembly within a cavity and a coupling arrangement, comprising a solid state actuator unit within the cavity, wherein the solid state actuator unit is designed for acting on the valve assembly and wherein the coupling arrangement comprises:

a fuel injector cup having a central longitudinal axis and being designed to be coupled to the fuel rail at a first axial end area of the fuel injector cup, a housing of the fuel injector being arranged at the central longitudinal axis facing a second axial end area of the fuel injector cup, an O-ring seal being arranged between the housing and the fuel injector cup at an axially overlapping area of the fuel injector cup and the housing, wherein when sealing, the O-ring seal being in direct contact with said housing and said fuel injector cup, a back-up ring being arranged at least partly circumferentially the housing such as to prevent the O-ring seal to be released from the housing, and a separating element being arranged at least partly circumferentially the housing between the O-ring seal and the back-up ring such as to prevent a contact of the O-ring seal with the back-up ring.

13. The fuel injector according to claim 12, wherein the back-up ring comprises stainless steel.

14. The fuel injector according to claim 12, wherein the separating element comprises a plastic or polytetrafluoroethylene.

15. The fuel injector according to claim 12, wherein the back-up ring comprises a larger outer diameter at a first axial end area of the back-up ring facing the separating element than at a second axial end area of the back-up ring facing away from the separating element.

16. The fuel injector according to claim 12, wherein the separating element comprises a larger outer diameter than the back-up ring.

17. The fuel injector according to claim 12, wherein the separating element comprises a flange, which is arranged at least partly at the fuel injector cup axially overlapping with at least a part of the back-up ring, wherein the flange is arranged such as to prevent a contact of the fuel injector cup with the back-up ring.

18. The fuel injector according to claim 12, wherein the housing comprises a first part of the housing facing the fuel injector cup and a second part of the housing facing away from the fuel injector cup, wherein the first part of the housing comprises a smaller outer diameter than the second part of the housing.

19. The fuel injector according to claim 12, wherein the O-ring seal, the separating element and the back-up ring are arranged at least partly circumferentially the first part of the housing.

20. The fuel injector according to claim 18, wherein the back-up ring is in contact with at least a part of the second part of the housing.

* * * * *